US005421690A

United States Patent [19]

Litterst

[11] Patent Number: 5,421,690

[45] Date of Patent: Jun. 6, 1995

[54] DEVICE FOR CONVEYING AND TURNING TRAYS LOADED WITH UTENSILS

[75] Inventor: Jürgen Litterst, Offenburg, Germany

[73] Assignee: Premark FEG Corporation, Deerfield, Ill.

[21] Appl. No.: 866,660

[22] Filed: Apr. 8, 1992

[30] Foreign Application Priority Data

May 4, 1991 [DE] Germany ..... 41 14 552.6

[51] Int. Cl.[6] ..... B65B 69/00; B65G 47/22; A47L 15/74

[52] U.S. Cl. ..... 414/418; 134/126; 134/128

[58] Field of Search ..... 414/403, 418; 134/126, 134/128; 198/803.2, 699.1, 408, 457; 186/43, 49, 50

[56] References Cited

U.S. PATENT DOCUMENTS

| | | | |
|---|---|---|---|
| 1,907,456 | 5/1933 | Stevenson | 414/418 X |
| 1,945,758 | 2/1934 | Turner | 414/418 X |
| 2,424,252 | 7/1947 | Orlando | 414/418 |
| 2,605,883 | 8/1952 | Thames | 414/418 X |
| 2,662,653 | 12/1953 | Bianchi et al. | 414/418 |
| 2,718,297 | 9/1955 | Wilde . | |
| 2,936,917 | 5/1960 | Musgrave | 414/418 |
| 2,951,603 | 9/1960 | Preuss | 414/418 |
| 3,044,642 | 7/1962 | Bycer et al. | 414/418 |
| 3,232,425 | 2/1966 | Le Van Hansen | 414/418 X |
| 3,451,570 | 6/1969 | Tobey | 414/418 |
| 4,167,999 | 9/1979 | Haggerty | 198/803.2 |

FOREIGN PATENT DOCUMENTS

| | | | |
|---|---|---|---|
| 0292773 | 11/1988 | European Pat. Off. . | |
| 1532988 | 5/1970 | Germany . | |
| 2306179 | 8/1974 | Germany | 198/699.1 |
| 2443651 | 4/1976 | Germany . | |
| 3413480 | 10/1985 | Germany . | |
| 111991 | 9/1979 | Japan | 414/418 |

*Primary Examiner*—David A. Bucci
*Assistant Examiner*—Stephen Gordon
*Attorney, Agent, or Firm*—Thompson, Hine and Flory

[57] ABSTRACT

An apparatus for conveying and turning trays loaded with utensils including a feed conveyor which conveys trays through and around a semi-circular turning track. The turning track is delimited laterally by stationary, curved rails and to the inside toward the central point of curvature by a continuous inner belt, and having removal devices at the top end. The inner belt is provided with uniformly spaced outwardly projecting rods. The feed conveyor is in the form of a continuously driven chain conveyor which is drawn through in one piece to the upper end of the turning track, guided in the region of the turning track by rails for the chains arranged on either side to more reliably guide the trays and in order to make the drive of the entire device more sturdy in design.

11 Claims, 3 Drawing Sheets

DEVICE FOR CONVEYING AND TURNING TRAYS LOADED WITH UTENSILS

Figure 1:
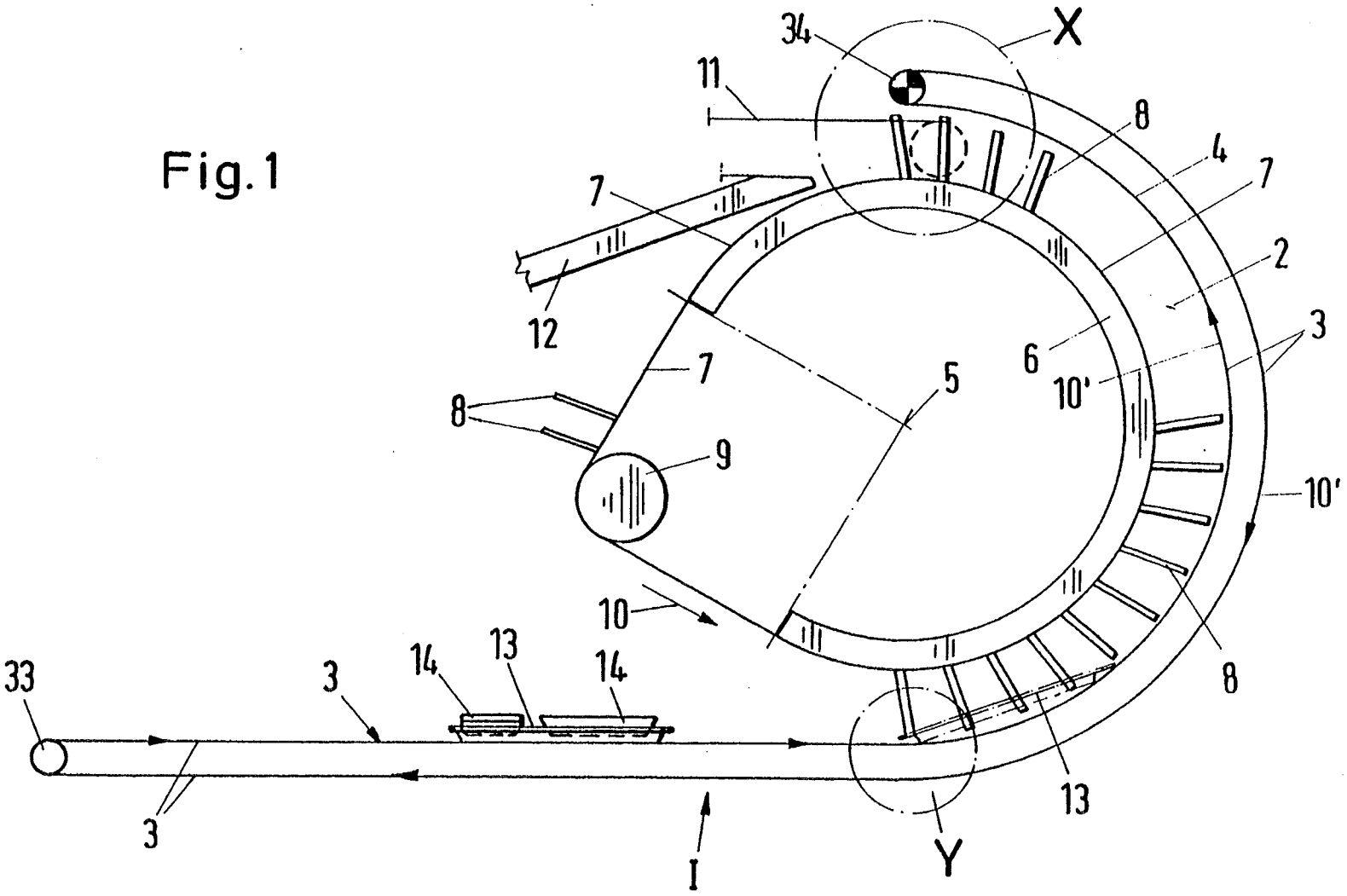

The invention relates to a device for conveying, turning and possibly sorting out trays loaded with utensils such as plates, bowls, cups and the like to dishwashers, the device having a feed conveyor which supplies the trays to the lower end of a turning track which is approximately semi-circular in cross-section, and having removal devices at the top end of the turning track which is delimited laterally by stationary curved rails and to the inside towards the central point of curvature by a continuous inner belt, and which is outwardly open, wherein the inner belt is provided at equal distances apart with outwardly projecting rods.

A machine which has the above-mentioned features is currently used in various canteens and restaurants, and is an improvement of a removal device disclosed in DE-PS 24 43 651 for used utensils. This known removal device has a removal drum which rotates about a horizontal axis and which has radially disposed elastic entrainment fingers arranged on the drum, opposite which is disposed a plurality of stationary curved rails which form a turning passage together with the drum surface. As viewed in the direction in which the removal drum moves, removal devices are provided behind the upper end of the turning passage, which removal devices are in the form of slides, belts or the like, and these serve to remove the trays arriving at the turned position which is favourable for the washing process, separately from the utensils.

DE-PS 34 13 480 has already disclosed a removal-, sorting- and conveying device which is similar to the known removal device described latterly. This more recent conveyance device for a dishwasher no longer uses radially outwardly projecting entrainment fingers disposed directly on the surface of the removal drum, but a continuous conveyor belt on which finger members are arranged at equal distances apart for taking hold of the trays of dirty utensils which are guided on the lower side of the turning passage. This conveyor belt is placed around the smooth surface of a roller-like turning drum, and is driven by friction by the drum, or by another direction-changing drum disposed at a distance away.

The conveyance device described in the introduction is already a simplification of the apparatus and devices disclosed in the publications. However, it is worth further improving it by removing all transfer stations, if possible, at the places where the various conveyors are joined. With respect to the conveyance and turning devices in use up until now, the drive and design of the guide tracks for the trays and utensils often give rise to certain problems if the previously known conveyance machines which have previously been used convey the items to be turned from the side which is oppositely disposed to the feed conveyor in the region of the turning track. In other words, the engagement operation between the item which is to be conveyed and the conveyor takes place at the bottom, outside the region of the feed conveyor, whilst the engagement operation in the region of the turning track takes place on the inside, above the inner belt and with the outwardly projecting rods. Hitherto, it has been impossible to prevent jamming and the conveyance operation to some extent takes place over the top of the items and to the outside. For this reason, the rods are only able to partially touch and convey the utensils by way of napkins or food remains.

The aim of the invention is therefore to improve the device of the kind mentioned in the introduction in such a way that the trays and utensils are reliably guided, and in such a way that the drive for the entire turning unit can be less prone to malfunctions and more sturdy in design.

According to the invention, this problem is solved in that the feed conveyor is in the form of a continuously driven chain conveyor which is pulled through in one piece up as far as the upper end of the turning track, the chain conveyor being guided in the region of the turning track by rails for the chains which are arranged on either side of the turning track. The expression, "in one piece" which is used here relates to the entire turning device when viewed from the side, wherein the feed region which is usually straight and substantially horizontal extends continuously without interruption, that is to say that it is without any joints, into the curved turning track and as far as the upper end thereof. The chain conveyor which is pulled through in one piece in this direction consists, when the device is viewed in perspective, of a pair of chain conveyors which pass through it, to be more precise of one chain conveyor on either side of the turning track. Therein, the turning track is in the form of a semi-cylindrical casing with two flat sides and the curved casing surface. On respective sides of the turning track, rails for the chains guide the respective chain conveyor in the new way from the feed region up to the upper end of the turning track. This feature advantageously means that according to the invention there is no transitional path to the items being conveyed, in this case to the trays loaded with utensils. According to the new system, the trays are only conveyed by the outer chain conveyor (which is always to be thought of as existing in a paired relationship), whilst the inner belt only performs holding and supporting functions and may not even need to be driven at all. However, with some preferred embodiments, the rotating inner retaining belt is also driven in synchronisation with the respective outer chain conveyor.

Those skilled in the art will see that the entire turning device gives rise to considerably fewer problems, and instead is sturdier in its overall structure. In addition, the drive of the turning unit can be simplified because the force for conveying the trays and utensils through the turning track basically only needs to be applied by the outer chain conveyor and introduced into the trays, whilst scarcely any effort has to be made to drive the inner rotating holding belt.

It is also expedient according to the invention if arranged on the inner belt, preferably in the form of a rack-like belt, in the direction in which the belt moves forwards are holding rods which are inclined through at least 10°, so that the free outer ends thereof almost reach the level of the curved inner edge of the chain conveyor. The inner holding belt is preferably in the form of a rack-like belt so that it runs on a track which is pear-shaped when viewed in cross-section. This continuous, rotatingly driven inner rack-like belt is composed of transverse rods which are pivotally joined together by strips, in the same way as a bicycle chain. Sitting between the crossbars on feet between the strips which bridge the gap between the rods are holding rods which project in the region of the turning track up into the trays or into the utensils placed on the trays, for the purpose of preventing utensils and trays from falling down or slipping away. A special lifting or conveyance force for the turning track does not need to be applied by the holding rods. This inner rack-like belt is guided in the pear configuration by way of its transverse rods because arranged at either end of the respective transverse rods are freely rotatable rollers which are guided by rails (in this case by pairs of rails once again) which are of a matching pear-like configuration. Therein, the rack-like belt is driven by a pair of toothed wheels. The space between the two guide rails is spanned in cantilever-fashion by the rack-like belt which carries out the holding function alone. Thereby, the turning track is open inwardly towards the central point of curvature, and food remains can fall through between the rods of the belt during the turning process. The rack-like belt which performs the holding function is driven by the afore-mentioned pair of toothed wheels, wherein the teeth of the toothed wheels engage into the edges of the rack-like belt between the rollers on the transverse rods.

According to the above-described feature whereby the holding rods are inclined, the holding rods thus no longer project radially to the outside, as is currently the case with known machines, but are made more rigid because of their initial inclination. If a radial line is imagined as existing in the region of the turning track from its central point of curvature to the outside, then the longitudinal central line of the holding rods is tilted at least 10° relative to the imaginary radial line at the front in the direction of rotation of the rack strap, wherein the inclination can also be 15° and 20°, but 15° being preferable.

Both the rails for the chain conveyor and also the connecting link guide rails for the holding rack-like belt are arranged in the region of the turning track at the side thereof and at the side of the holding rods, so that the outer free end of the holding rods can rotate without any outer supports and without any facing member. The facing member results firstly from the actual items being turned, in particular from the trays which are of standardised width enabling them to reach from one side of the turning track to the other and which are easily supported laterally by the pair of chain conveyors. Utensils placed on the trays, and also the trays themselves, are supported and held and prevented from slipping off the holding rods. The conveyance and force required to push the parts to be turned is applied by the outer chain conveyor. If the chain conveyor is viewed from the side, when the visible line is rotated a curved inner edge results which is that of the semi-circle which results at the level of the inner edge of the chain conveyor by the rotating visible line. The free outer ends of the holding rods extend up to approximately this level. This gives the particularly favourable feature whereby the holding rods can perform their holding and supporting functions, if trays and possibly also utensils placed on the trays are guided together with the trays through the turning track.

With a further advantageous embodiment of the invention, the chain conveyor has a number of conveyance projections which project outwardly from at least some of the chain members. These conveyance projections are provided for the purpose of engaging with edges present anyway on the trays or items to be turned, so that a special kind of form-locking occurs in order that the entire pushing and conveying force required can be applied to the items to be turned by the outer chain conveyor.

Therein, it is particularly expedient if according to the invention the conveyance plates are made of plastics material, or the like, and are form-lockingly connected to the chain members of the chain conveyors by spring catches or similar means. This design permits the use of one single chain conveyor with chain members, and for pivotal connections joining together the members by means of pins to be removed from the standardised standard programs and used, wherein only the conveyance plates have to be specially designed and preferably provided with locking means in order to enable the turning track to perform its full function for the trays.

It is also expedient according to the invention if the flat sides of the turning track are delimited by supporting side walls which connect together the rails for the chain of the chain conveyor and the connecting link guide rails of the inner rack-like belt. The device is thereby visibly simplified and made more sturdy in design, and if the supporting side walls are of an appropriate size the entire turning region can be closed off towards the outside so that sprays of water can be applied from all sides to the turning track and to the items which are being guided around inside it, so that excellent preliminary cleaning is achieved.

The invention is also advantageously characterised in that each rail for the chain has a longitudinal groove which is only open towards the turning track and which preferably has undercut portions for guidingly receiving runners arranged rotatably outside each chain conveyor. It is true that rails for the chains can be provided for the upper part of the belt separately from the lower part of the belt of the chain conveyor. However, the rails can also be designed or connected integrally, if only one longitudinal groove is provided for the each part of the belt. Each chain conveyor of the pair is disposed on one side of the turning track, on the aforementioned flat side, and the grooves open towards one another, so that each chain conveyor permits runners which project at the side of the turning track to be pushed into the longitudinal grooves. In other words, the guides of the pair of chain conveyors are on the sides of the turning track, whilst the space on the inside is open. The advantages resulting from this are favourable supply of sprays of water to any part of the turning track and also favourable removal of food remains, napkins or other particles of dirt or substances from the trays and utensils to be cleaned. The runners safely pass into the longitudinal grooves of the rails for the chains without any obstruction, and ensure that operation is smooth and reliable.

Figure 3:
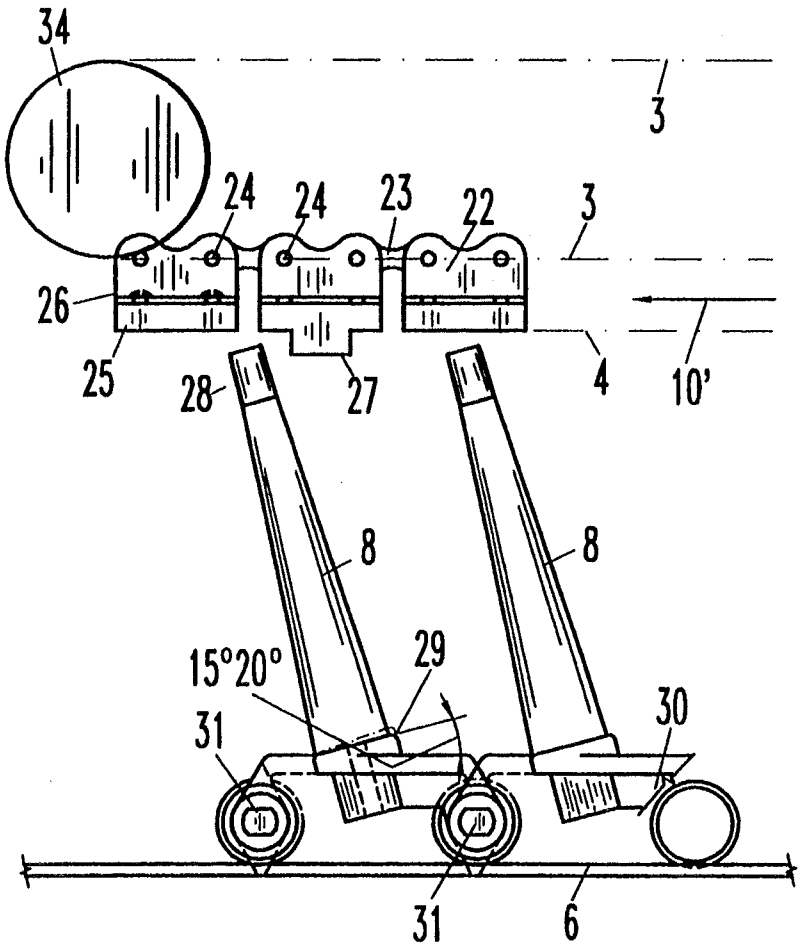
Figure 2:
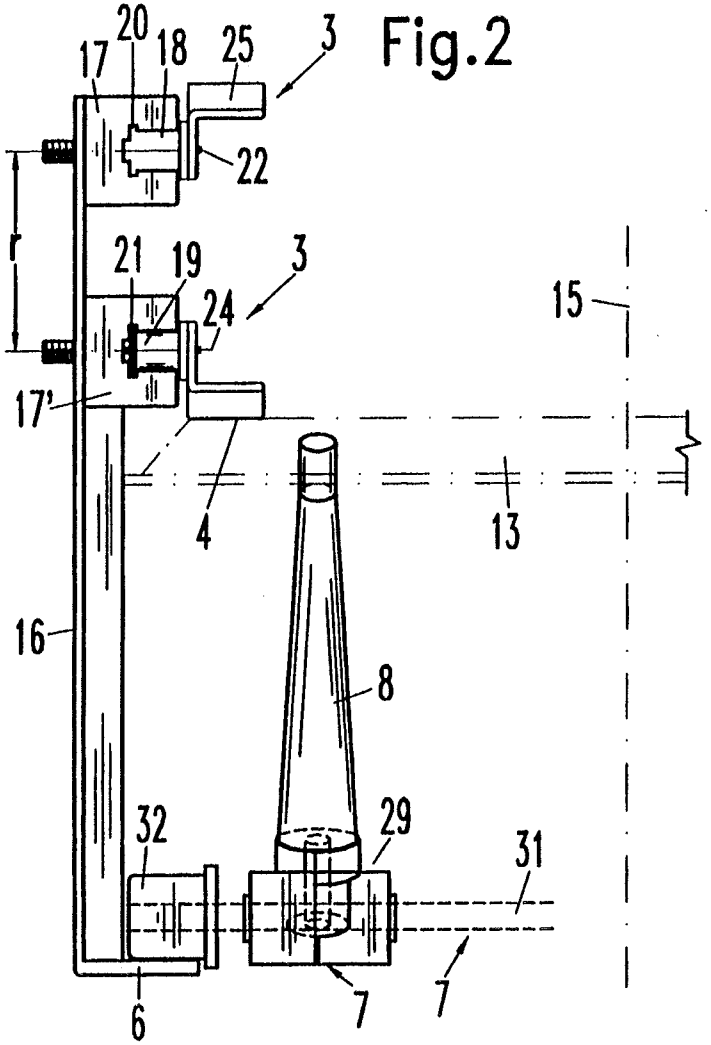
Figure 4:
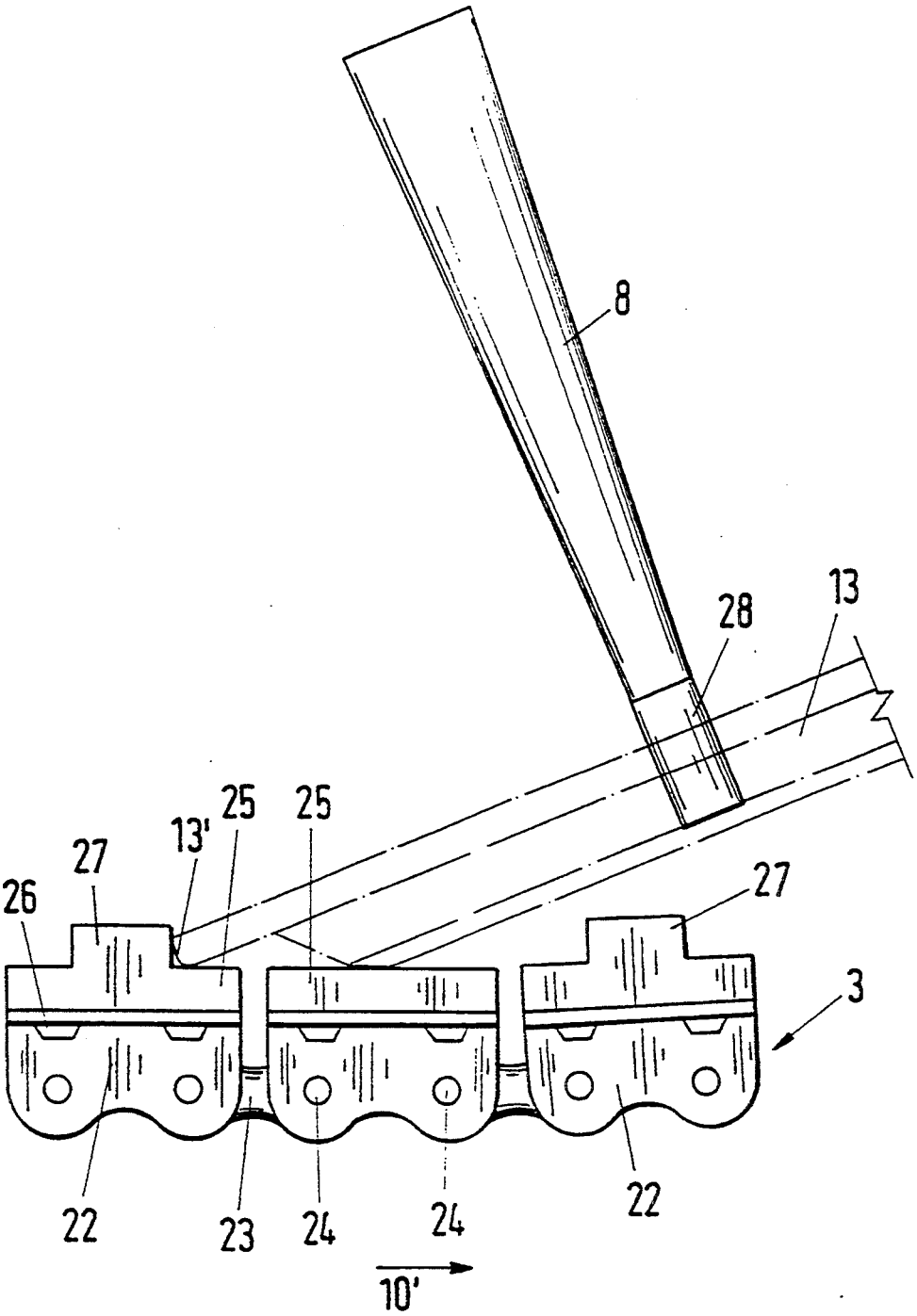

Further advantages, features and possible applications of the present invention will emerge from the following description of preferred embodiments, given in conjunction with the accompanying drawings, wherein:

FIG. 1 is an illustrative side view of the feed conveyor and turning region of the device according to the invention with the removal devices and the pear-shaped rotating inner rack strap, FIG. 2 shows a cross-sectional view at the top end X of the turning track, looking at the drawing in FIG. 3 from the left to the right, FIG. 3 shows the detail X in the region of the circle, marked by a broken line, at the top end of the turning track, and FIG. 4 shows a broken away view, partly illustrated, of an individual view of the bottom end Y of the turning track in FIG. 1, in the region of the lower, smaller circle, marked by a broken line.

Figure 5:
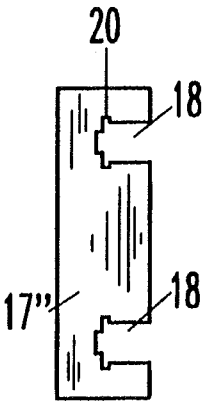

FIG. 5 shows another preferred embodiment of the stationary, curved rails of the chained conveyor.

The turning device of the embodiment shown here, from the conveyance region I and extending over a turning track 2 to the upper end X, has a chain conveyor 3 which is pulled through in one piece over the entire region. The side view of FIGS. 1, 3 and 4 shows this chain conveyor 3 in the form of a belt with chain members. However, it will be appreciated that another rear chain conveyor of the same design is arranged above the width of the device at a spacing behind the front belt, and that it rotates synchronously with the front belt. Therefore, for the sake of clarity, only the front chain conveyor 3 shown in FIG. 1 will be described.

In the conveyance region I, this chain conveyor runs horizontally and makes a transition at the bottom end Y of the turning passage 2 into a region which is curved into a semi-circular configuration when viewed from the side, and which ends at the upper end, on the outlet side, X of the turning passage 2.

The inner curved part of the belt of the chain conveyor 3 is considered as being the curved inner edge 4 which is oppositely disposed to a second curved inner edge 4 of the other chain conveyor 3 at a spacing corresponding to the width, not shown in the drawings, of the turning passage 2 in FIG. 1. If the device shown in FIG. 1 were viewed from inner edge 4 toward rear central point of curvature 5, then chain conveyor 3 and the other chain conveyor 3, which are spaced apart from each other, would form an imaginary semi-cylindrical casing-like surface. This surface is actually completely open with the embodiment shown here, however.

Extending substantially parallel to the chain conveyor 3 at a uniform predetermined spacing from the curved inner edge 4, inside towards the central point of curvature 3, are stationary curved connecting link guide rails 6, which exist in pairs like the afore-mentioned rails for the chain conveyor, and by means of which connecting link guide rails 6 an inner rack-like belt 7 is pulled which has outwardly projecting rods 8 at equal distances apart. This continuous, inner rack-like belt 7 runs on a track which is pear-shaped in the side view given in FIG. 1 and it includes the central point of curvature 5. A pair of toothed wheels 9 is arranged to be rotatably driven towards the side of the central point of curvature 5, remote from the turning passage 2, about which point the rack-like belt 7 also runs, wherein the toothed wheels 9 which are joined together by a shaft, not shown, engage by virtue of their teeth into the inner rack-like belt 7 enabling them to be driven. The direction of rotation of the inner rack-like belt 7 is shown by the arrow 10, and moves counter-clockwise about the central point of curvature 5 synchronously with the inner part of the belt (inner edge 4) of the chain conveyor 3 arranged on the outside behind the turning track 2, the direction of rotation of the chain conveyor being shown by the two curved arrows 10'.

Disposed behind the curved stationary rail 6 shown in FIG. 1 at a spacing away from it which is approximately equal to the width, not shown, of the turning passage 2, is another curved rail 6, and the surface which stretches out therebetween is spanned in cantilever fashion by the rack-like belt 7.

At the upper end X of the turning track 2, a conveyor belt 11 which is shown in a broken away manner passes around a direction-changing roller, merely outlined and not shown in greater detail, which acts as a removal device. Somewhat more deeply seated and passing inclinedly in the direction of movement of the belt 7, as marked by the arrow 10, is a slider 12 which likewise acts as a removal device. The trays which are turned leave the upper end X of the turning passage 2 by way of the conveyor belt 11, and the utensils still held by the holding rods 8 are taken from the removal slider 12 as they leave the turning passage, and are conveyed to further conveyance devices, not shown here, to be taken to the dishwashers.

In FIG. 1, solid lines are used to show a tray 13 with utensils 14 placed on it in the conveyance region I, and broken lines are used to show the tray (without the utensils) in the bottom region of the turning passage 2.

In FIG. 2 it is possible to see one of the chain conveyors 3 arranged in pairs and the design of which will now be described in greater detail. Therein, reference need only be made to one of the two chain conveyors 3, because the respective other chain conveyor is a mirror image beginning at the line 15, shown by broken lines, to the right in FIG. 2.

Disposed on one of the mutually opposite supporting side walls 16 to the left of the plane of symmetry 15 in the upper region are two stationary curved rails 17, 17' which are arranged above each other at a radial spacing r, and which are mainly disposed in the region of the turning passage 2. Another embodiment of these rails 17, 17' is shown in FIG. 5, wherein the two separate curved rails are held in one unitary block 17''. Both the individual rails for the chains 17, 17' and also the plate-like design of the block 17'' for the rails for the chains has a longitudinal groove 18 which is open only towards the turning track 2, open to the right in FIG. 2, and which in width is such that it receives the diameter of one runner 19. At the base of each longitudinal groove 18 there is an undercut portion 20 for the purpose of receiving plates 21 which project radially across the diameter of the runners 19, by means of which undercut portion the runners 19 are prevented from sliding out of the longitudinal grooves 18.

Disposed on each runner 18, on the side facing the turning passage 2 is the chain member 22 of the inner (inner edge 4) or outer part of the belt of the chain conveyor 3. These chain members 22 are connected together by way of hinge connections 23, in a similar way to a bicycle chain, as also illustrated in FIGS. 3 and 4. The cross-sectional view in FIG. 2 shows that each chain member 22 is of an L-shaped configuration, wherein the one limb of the L is joined to the axle 24 of the runner 19, and wherein a conveyance plate 25, preferably made of plastics material, is preferably form-lockingly attached to the other limb of the L. Spring catches 26 which are mushroom-shaped in cross-section and split longitudinally for flexibility, are provided in the longitudinal extent, and are responsible for making a firm connection between the conveyance plate 25 and the chain member 22. As viewed in the direction 10' in which the chain conveyor 3 moves, every other conveyance plate 25 has at least one conveyance projection 27 which is responsible for the form-locking engagement between the chain conveyor 3 and the items to be conveyed, such as the tray, for example.

The unit denoted by the letter Y in FIG. 1 at the bottom entrance to the turning passage 2 is shown on a larger scale in FIG. 4 where it is shown in form-locking engagement between the rear edge 13' of the tray 13, on the one hand, and the conveyance projection 27 of the conveyance plate 25, on the other hand.

During operation, trays 13 loaded with utensils 14 are placed onto the chain conveyor 3 in the conveyance region I in such a way that the tray 13 spans the space between the two chain conveyors 3 disposed at a spacing apart in cantilever fashion. In this way, the loaded tray 13 moves, as shown in FIG. 1, from left to right to the bottom end Y of the turning track 2.

At that place, i.e. at the bottom end Y of the turning track 2, there is no conveyance transition from a first conveyor to a second conveyor. Instead, the chain conveyor 3 maintains its conveyance function even when the curved turning passage 2 is moving up to the upper end X. Whilst friction contact between the chain conveyor 3 and the tray 13 in the region of conveyance I is quite sufficient for conveyance purposes, from the bottom entry end of the turning passage 2 in the region Y (see FIG. 4) it is expedient if a form-locking connection is made in addition, especially since it is now only really the front and back of the tray 13 which are in contact with the inside part of the belt of the chain conveyor 3. So that the tray, and first and foremostly, utensils 14 placed on the tray, do not slip down, or are not prevented from moving up into the region of the turning passage 2, the ends 28 of the holding rods 8 which are inclined at the front in the direction of conveyance 10 relative to the holding rods 8 which are inclined in the respective radial extent engage either with the tray 13 shown in FIG. 4, or with the utensils placed on the tray and/or the tray 13 itself.

The upper free end 28 of the holding rods 8 does not engage with the chain conveyor 3, but passes adjacent to the height line or the curved inner edge 4 of the chain conveyor 3. The holding rods 8 are secured to feet 29 which are arranged between the strips 30 of the inner rack belt 7. The strips 30, in turn, are joined together by way of crossbars 31, on the ends of which are arranged freely rotatable rollers 32. These latter are guided by the connecting link guide rails 6 which are joined to the rails 17, 17' of the chain conveyor 3 by way of the supporting side walls 16.

Not only does the inner rack belt 7 rotate continuously, but the chain conveyor 3 does as well, to be more precise rotating about the two direction-changing rollers 33 and 34—partly guided by the rails 17, 17' and 17" for the chains, mainly in the region of the turning track 2.

After the tray 13, and possibly the utensils 14 placed on it, have entered the turning track 2, the holding rods 8 are responsible for keeping the utensils being conveyed in positions relative to each other, or for keeping the rear edge 13' in a position relative to the conveyance projection 27, so that the items can be moved up and turned without being substantially displaced.

After the upper end X of the turning passage 2 has been reached, the trays 13 are held by the conveyor belt 11 and carried away, whilst the rods of the conveyance slider 12 which engage between the holding rods 8 receive and carry away the utensils which are present.

I claim:

1. A device for conveying, turning and sorting trays loaded with utensils, said device having a feed conveyor which supplies the trays to a lower end of a generally vertically oriented turning track, said turning track being approximately semicircular in cross-section, said turning track being delimited laterally by stationary curved rails and to the inside toward the central point of curvature of said cross-section by a continuous inner belt, said turning track being outwardly open, and said turning track having removal devices at a top thereof, and wherein said inner belt is a rack-like belt and provided at equal distances apart with outwardly projecting rod means for contacting a top surface of said trays and urging said trays toward said feed conveyor, said outwardly projecting rod means are inclined at an angle of at least 10° from an imaginary line perpendicular to said inner belt, the outer ends of said projecting rod means nearly reaching a surface of said chain conveyor and said inner belt being guided by connecting link guide rails; said feed conveyor being in the form of a continuously driven chain conveyor, which is pulled through said turning track in one piece, said chain conveyor being guided through said turning track in one piece, said chain conveyor being guided through said turning track by said stationary curved rails, said stationary curved rails being arranged on either side of said turning track.

2. A device for conveying, turning and sorting trays loaded with utensils, said device having a feed conveyor which supplies the trays to a lower end of a generally vertically oriented turning track, said turning track being approximately semicircular in cross-section, said turning track being delimited laterally by stationary curved rails and to the inside toward the central point of curvature of said cross-section by a continuous inner belt, said turning track being outwardly open, and said turning track having removal devices at a top thereof, and wherein said inner belt is provided at equal distances apart with outwardly projecting rod means for contacting a top surface of said trays and urging said trays toward said feed conveyor, said outwardly projecting rod means are inclined at an angle of at least 10° from an imaginary line perpendicular to said inner belt, the outer ends of said projecting rod means nearly reaching a surface of said chain conveyor and said inner belt being guided by connecting link guide rails; said feed conveyor being in the form of a continuously driven chain conveyor, which is pulled through said turning track in one piece, said chain conveyor being guided through said turning track in one piece, said chain conveyor being guided through said turning track by said stationary curved rails, said stationary curved rails being arranged on either side of said turning track.

3. A device according to claim 2, wherein said chain conveyor has conveyance plates and conveyance projections, said conveyance projections projecting outwardly from at least some of the chain members.

4. A device according to claim 3 wherein said conveyance plates are form-lockingly connected to said chain conveyor by spring catches.

5. A device according to claim 2, wherein said turning track is further delimited by supporting side walls, which are connected to said stationary curved rails and said connecting link guide rails.

6. A device according to claim 2, wherein said stationary curved rails have a longitudinal groove, said groove being open towards said turning track, and wherein said groove has undercut portions for guiding said chain conveyor.

7. A device according to claim 3, wherein said turning track is further delimited by supporting side walls, which are connected to said stationary curved rails and said connecting link guide rails.

8. A device according to claim 4, wherein said turning track is further delimited by side walls, which are connected to said stationary curved rails and said connecting link guide rails.

9. A device according to claim 3, wherein said stationary curved rails have a longitudinal groove, said groove being open only toward said turning track, and wherein said groove has undercut portions for guiding said chain conveyor.

10. A device according to claim 4, wherein said stationary curved rails have a longitudinal groove, said groove being open only toward said turning track, and wherein said groove has undercut portions for guiding said chain conveyor.

11. A device according to claim 5, wherein said stationary curved rails have a longitudinal groove, said groove being open only toward said turning track, and wherein said grooves have undercut portions for guiding said chain conveyor.

* * * * *